United States Patent [19]

Hoh et al.

[11] Patent Number: 4,505,162

[45] Date of Patent: Mar. 19, 1985

[54] OIL WELL PUMPING APPARATUS AND METHOD

[75] Inventors: Thomas G. Hoh, Boulder, Colo.; Bernard L. Friedman, Carmel Valley, Calif.; Wendall Borchert, Boulder; Eugene H. Nixon, Jr., Arvada, both of Colo.

[73] Assignee: Advanced Pumping Systems, Inc., Lafayette, Colo.

[21] Appl. No.: 400,637

[22] Filed: Jul. 22, 1982

[51] Int. Cl.[3] ..... F04B 47/02

[52] U.S. Cl. ..... 74/41; 74/108; 74/591; 74/600

[58] Field of Search ..... 74/41, 591, 108, 600

[56] References Cited

U.S. PATENT DOCUMENTS

| | | | |
|---|---|---|---|
| 1,588,784 | 6/1926 | Trout | 74/591 |
| 1,706,407 | 3/1929 | Miller et al. . | |
| 1,770,880 | 7/1930 | Fraser | 74/591 |
| 1,917,701 | 7/1933 | Crites et al. | 74/591 X |
| 1,931,472 | 10/1933 | Archer | 74/591 |
| 2,035,525 | 3/1936 | Bloss | 74/41 |
| 2,106,945 | 2/1938 | Francis | 74/600 |
| 2,189,893 | 2/1940 | Fuller | 74/591 |
| 2,219,080 | 10/1940 | Slonneger | 74/591 |
| 2,269,729 | 1/1942 | O'Leary | 74/41 |
| 2,575,075 | 11/1951 | Eaton | 74/591 |
| 2,627,759 | 2/1953 | Fincher | 74/591 |
| 2,739,493 | 3/1956 | Eaton | 74/591 |
| 2,741,141 | 4/1956 | De La Mater | 74/591 |
| 2,805,580 | 9/1957 | Kane | 74/41 X |
| 2,867,134 | 1/1959 | Scherf et al. | 74/600 |
| 3,222,940 | 12/1965 | Chastain | 74/41 |
| 3,371,554 | 3/1968 | McCray et al. | 74/600 |
| 3,406,581 | 10/1968 | Eyler et al. | 74/591 X |

*Primary Examiner*—Rodney H. Bonck

[57] ABSTRACT

An oil well pumping apparatus and method has an increased walking beam distance ratio of saddle pivot-polished rod distance (DE) to saddle pivot-equalizer pivot distance (DC) of at least 1.4:1. A crank arm axis (A) is positioned substantially to the rear of the equalizer pivot (C) and the pitman rod (21) is connected to the crank arm (16) at any selected stroke point along a crank arm wrist pin angle line (AB) offset at an angle ($\phi$) to the center line of the crank arm. A precise counterbalancing is provided by radial adjustability of a weight assembly (17) on the crank arm, a floating safety lock assembly (64), and the addition to or subtraction from auxiliary weights (57) on a main weight member (54). The beneficial results of the present invention include reduction of peak torque requirements, elimination of gear reducer load reversals, and lower sucker rod stress throughout a very wide range of pumping applications with a universal piece of hardware.

15 Claims, 12 Drawing Figures

OIL WELL PUMPING APPARATUS AND METHOD

TECHNICAL FIELD

This invention relates to a novel and improved oil well pumping apparatus and method.

BACKGROUND ART

The most widely used type of pump in the oil and gas industry is known as the sucker rod pump. The pump is placed at the bottom of the downhole tubing near the reservoir. The pump is connected to an oil well pumping unit at the ground surface by a series of sucker rods with a polished rod and flexible cable above the ground. The oil well pumping unit moves the interconnected rods up and down, activating the pump and moving oil to the surface.

This oil well pumping unit includes a prime mover coupled via a gear reducer to a pair of crank arms that are rotated at one end about a fixed axis. A counterweight is mounted at the free end of each crank arm. A pitman rod is connected to each crank arm at one end and to an equalizer at the other end. The equalizer is connected to a walking beam that pivots up and down about a saddle pivot at the upper end of a sampson post. A horsehead is mounted on the front end of the walking beam allowing a flexible cable connection (bridle) to a polished rod which extends from the horsehead down into the well and is connected to the pump via the sucker rods.

In general, the conventional oil well pumping unit has used a random, inefficient linkage between the gear reducer and the polished rod where the primary consideration has been in meeting the stroke requirements for a given pumping unit. The conventional oil well pumping unit has the equalizer pivot directly above the crankshaft axis; it has no offset angle between the crank arm wrist pin line and the counterbalancing weight center of gravity line, and the ratio of saddle pivot-polished rod distance to saddle pivot-equalizer pivot is usually less than 1.4:1.

The disadvantages of the above described conventional pumping unit are an approximately 40% higher torque requirement than necessary, harmful gear reducer load reversals during portions of the crank arm cycle, a high upstroke rod velocity, rod stress, and rod fatigue failures. A further disadvantage in presently used pumping units is that they accommodate only one fixed size gear reducer, they have one specific structural capacity limitation, they have only two or three stroke length changes possible, and each length change is so far apart that there is virtually no fine tuning capability.

Conventional pumping unit design practices presently require seventeen API pumping unit sizes to accommodate a range of strokes between 88" and 168" and a range of gear reducer torques between 320,000 inch pounds and 912,000 inch pounds, and eighteen API pumping unit sizes to accommodate a range of strokes from 52" to 100" and a range of gear reducer torques between 114,000 inch pounds and 320,000 inch pounds.

In the prior art, McCray et al U.S. Pat. No. 3,371,554 discloses a connection between the pitman rod and the crank arm at only one of three discrete, spaced apart positions along an offset crank arm wrist pin angle line and also discloses a counterweight that adjusts to different positions along the crank arm. Miller et al U.S. Pat. No. 1,706,407 discloses a rack and gear arrangement to adjust the position of the counterweight along the crank arm.

Scherf et al U.S. Pat. No. 2,867,134 discloses an adjustable connection between the pitman rod and crank arm along the axis of the crank arm.

DISCLOSURE OF INVENTION

The oil well pumping apparatus and method disclosed is characterized by the combination of an increased ratio of saddle pivot-polished rod distance to saddle pivot-equalizer pivot distance of at least 1.4:1, the positioning of the crank axis rearwardly of the equalizer pivot a substantial distance, and the connection of the pitman rod to the crank arm at any selected point along an adjustable stroke setting line offset at an angle to the center line of the crank, together with a precise counterbalancing for a given oil well loading profile provided by a universal counterweight assembly to reduce the peak torque requirements, eliminate undesirable gear reducer load reversals, and lower sucker rod stress throughout a very wide range of pumping applications.

BRIEF DESCRIPTION OF DRAWINGS

The details of this invention will be described in connection with the accompanying drawings, in which.

DETAILED DESCRIPTION

Figure 1:
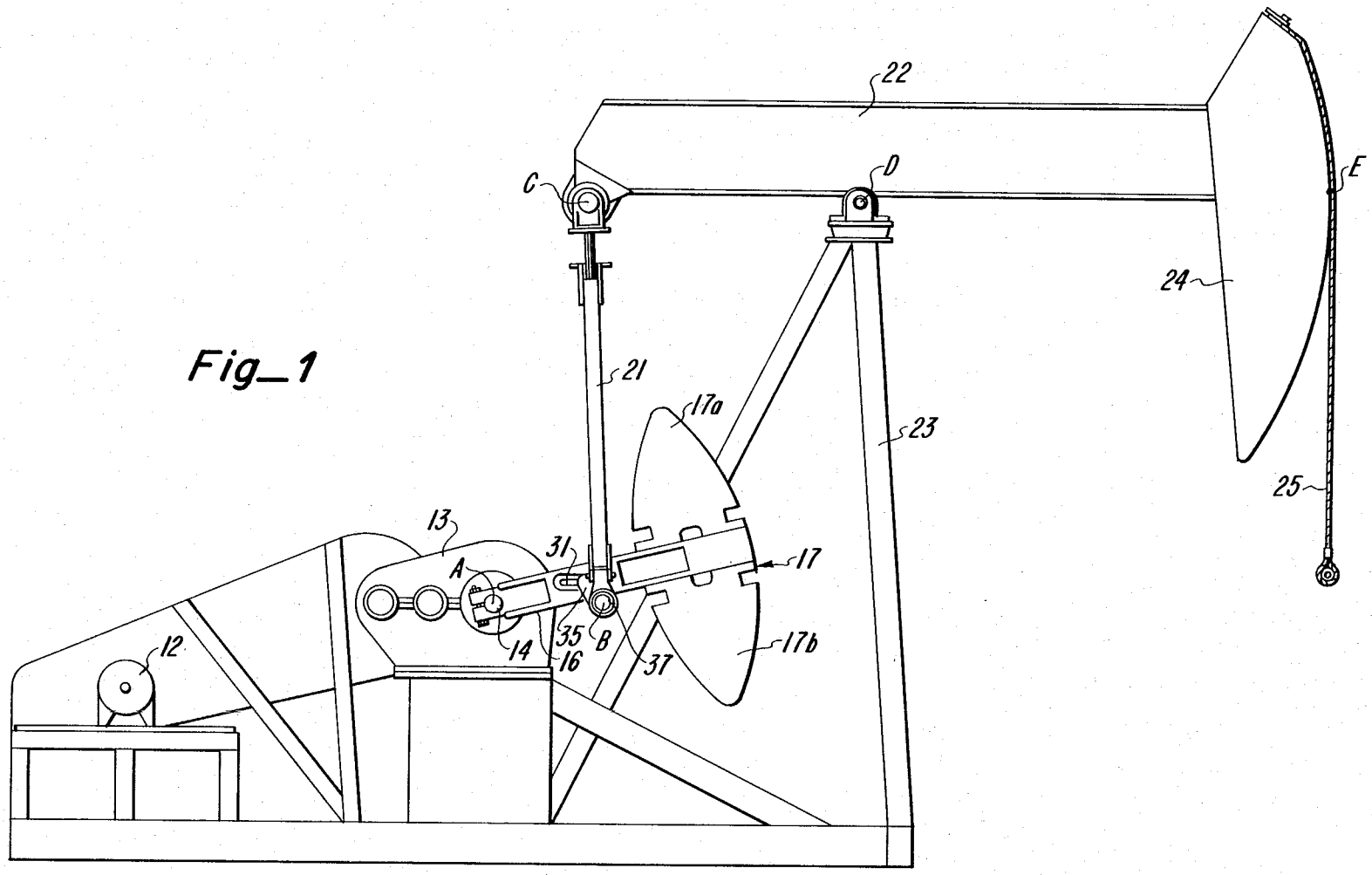
FIG. 1 is a side elevational view of oil well pumping apparatus embodying features of the present invention.
Figure 2:
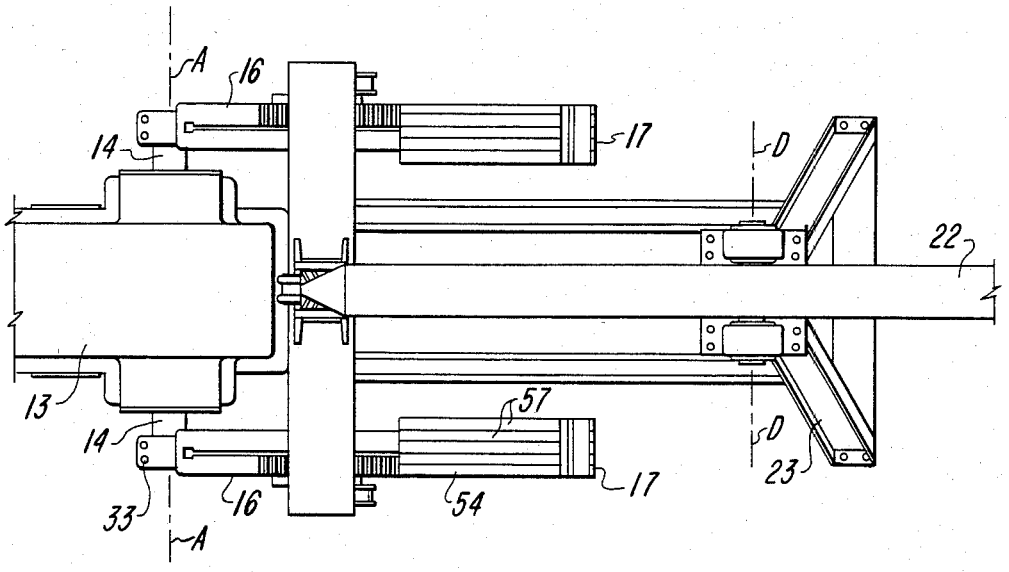
FIG. 2 is an enlarged top plan view of a portion of the apparatus shown in FIG. 1.

Referring now to FIGS. 1 and 2, there is shown an oil well pumping apparatus including a prime mover 12 driving a gear reducer 13 having a pair of output drive shafts 14 extending out in opposite directions and rotatable about a fixed axis designated A.

A crank arm 16 is mounted on each shaft 14 in a dual crank arm arrangement, as is conventional in oil well pumping apparatus. Each crank arm 16 shown has a counterweight 17 mounted opposite the axis of rotation A which, as shown, includes an upper weight assembly 17*a* and a lower weight assembly 17*b*. A pitman rod 21 is pivotally connected at the lower end to each crank arm in a dual pitman rod arrangement, which in turn is connected by a transverse equalizer at an equalizer pivot C to the rear end of a walking beam 22.

Each of the pairs of crank arms 16, counterweights 17, and pitman rods 21 are of identical construction and are oriented on the left and right sides of the longitudinal center line of the pumping apparatus. The right side elements will be described in detail with the understanding that each left side element has the same construction but is a mirror image of the right side element.

The walking beam 22 is pivotal up and down about a saddle pivot D on a sampson post 23. The beam 22 has a horsehead 24 at the front end with a bridle 25 fastened thereto allowing the sucker rod string down into the well to drive the downhole pump (not shown) near the reservoir of oil.

The point at which the bridle contacts the horsehead in the same plane as the saddle pivot D is designated E. The saddle pivot-polished rod distance is designated DE and the saddle pivot-equalizer pivot distance is designated CD.

The crank arm 16 is of a generally rectangular cross section and has opposed outer and inner side faces 26 and 27, respectively, a top face 28, and a bottom face 29. The rear end portion of the crank arm has a transverse bore 31 with a keyway hole to provide a shaft fitting that slidably receives the output shaft 14 of the gear reducer 13. There is a slot 32 between upper and lower sections of the rear end portion of the crank arm, together with a pair of cap screws 33 that extend vertically through the rear end section and clamp the crank arm 16 to the output shaft 14 so that each crank arm is rotated conjointly with the associated output shaft 14.

A wrist pin assembly 34 is slidably mounted in an inclined slot 35 in an intermediate portion of each crank arm and is lockable at any point along the slot to secure each crank arm 16 to the associated pitman rod 21 during the operation of the pumping unit to provide a variable offset connection between the lower end of the pitman rod and the crank arm. The wrist pin assembly 34 includes a support plate 36 having a wrist pin 37 that projects out from the outer side face thereof adjacent one end and a tapered projecting section 38 that extends out from the inner side face of the support plate 36 at the opposite end. The tapered projecting section 38 slide-fits in a tapered channel 39 in the outer face of the crank arm around the slot to slide along the recess in a close-fitting relationship until tightened down.

A fastening arrangement in the form of a pair of bolts 41 extends through the support plate 36, tapered section 38 and the slot 35. Each bolt 41 has a nut 42 threaded thereon and this nut is countersunk in a recess 43 in the inner face of the crank arm. The bolt and nut arrangement functions to lock the support plate 36 to the crank arm at any setting along the inclined slot. The heads of the bolts 41 are shown to be recessed in a bore 44 in the outer side face of the support plate 36.

Slot 35 extends at an acute angle to the longitudinal center line of the crank arm as viewed from the side, which is also the counterbalance weight center of gravity line. Slot 35 opens through the outer and inner faces of the crank arm.

To adjust the stroke length, both of the pitman rods 21 are disconnected at their lower ends from the wrist pin 37 and each of the pair of fastening bolts 41 is loosened. Each wrist pin assembly 34 is then slid along its inclined slot 35 with the bolts 41 providing a guiding action to a new position.

A pointer 46 carried by support plate 36 moves along on a vernier scale 47 carried on the outer side face of the crank arm to indicate each stroke setting on the scale. The vernier scale is marked with stroke distance indicia, as for example in one inch increments, between 88" and 168". Once the stroke has been selected, the nuts 42 are retightened, the tapered section 38 of each forming a taper lock in the tapered recess in the crank arm. The pitman rods 21 are then attached to the wrist pins 37 and the pumping unit is ready for operation. The upper half of the stroke range is covered with the mirror image wrist pin assemblies as shown and the lower half of the stroke range is covered with the mirror image wrist pin assemblies interchanged (dashed lines showing assembly 34' with pointer 46' and wrist pin center B'). This wide range of stroke settings covers a very broad range of pumping applications.

This crank-pitman offset coupling arrangement maintains a constant angle designated $\phi$ between the crank arm wrist pin line designated AB and the crank arm center line (which is also the counterbalance weight center of gravity line) independent of the setting for the pitman rod 21.

A universal counterbalancing assembly is provided by a structural arrangement which permits the radial position adjustment of the counterweight assembly 17 along the crank arm 16 and the selection of a precise amount of weight for a given oil well load profile. This correct counterbalancing is necessary to precisely counterbalance a given oil well loading profile to reduce the twin peak torques hereinafter discussed to a minimum amplitude. There is provided a series of upper rack teeth 51 formed in and extending along the upper face of the crank arm and a series of lower rack teeth 52 formed in and extending along the lower face thereof. The upper weight assembly 17*a* and the lower weight assembly 17*b* are of an identical construction and are fastened in the same manner so that the description of the upper weight assembly 17*a* also applies to the lower weight assembly 17*b*.

The upper weight assembly includes a main weight member 54 provided with a center hole 58 having an enlarged bore section 59 at the outer end adjacent the outer face and a narrower intermediate bore section 60. Center hole 58 receives a conventional gear wrench assembly that works in conjunction with the upper gear rack teeth 51 for the initial radial positioning of the main weight member. The main weight member 54 is further provided with a conventional inboard tee bolt 61 in a recess 61*a* and an outboard tee bolt 62 in a recess 62*a* of the crank arm which have heads that slide in tee grooves 79 in the crank arm for clamping the weight to the crank arm at the inboard and outboard ends, respectively, once the position for the main weight member 54 has been determined.

The main weight member 54 has three holes 55 arranged in a triangular pattern which receive bolts 56 for adding one or more auxiliary weight members 57, preferably of the same weight as the main weight member 54, to increase the total weight as required. The auxiliary weight members are stacked side by side one on another on the inside face of the main weight member in a laminate fashion.

A floating safety lock assembly 64, shown, in disposed in the center hole 58 which is installed after the correct radial positioning of the main weight member 54 has been accomplished using the gear wrench. This floating safety lock assembly includes a lock member 65 with a depending tooth portion 66 that seats in one of the rack teeth grooves between a pair of adjacent rack teeth 51 and has a slot 67 through which a locking bolt 68 extends. A guide member 71 with a hole 72 is alined with the slot and has a head disposed in a groove on the inner face of the member 65 to aline it with the locking bolt 68 and inserts into bore section 60 serving to guide the bolt 68 into the hole 58. The locking bolt 68 has external threads that thread into a tapered lock nut 74 inwardly of member 71. Nut 74 has a beveled surface 75.

A tee bolt 77 having a head 78 at the bottom end is carried in the tee slot 79 in the top of the crank arm and the upper end of the tee bolt extends through a vertical hole 81 in the main weight member 54. The tee bolt has a tapered hole 82 aligned with the hole 58 in the main body member with a tapered surface 83 along which the beveled surface 75 of the lock nut extends.

There is further provided a snugging bolt 85 that extends through a hole 86 in the lock member 65 having a head 87 at one end engaging a wall of the elongated bore section 59 and a nut 88 at the opposite end engaging the opposite wall of section 59. A nut 91 engages the locking member and a nut 92 provides a double nut lock.

In the operation of the floating safety lock assembly, the guide member 71 is placed in the center hole 58, and particularly in intermediate bore section 60, and the gear lock member 65 is set in the crank rack 51 as centrally as possible in weight opening 59. The tapered lock nut 74 is inserted at the rear of the main weight member, and the lock bolt 65 is inserted and tightened to pull the lock nut 74 so as to apply tension on the main weight member through the tee bolt 77, which was previously placed in the tee groove 78. A snugging bolt 85 is then turned so that its head is firmly against one side of the enlarged bore section of the main weight memeber and the other nut 88 is turned against the other side of the enlarged bore section, the double nuts 91 and 92 providing axial locking of the entire assembly at its precise location.

This floating lock assembly provides safety against weight loosening due to rapidly changing loads and the vibrating characteristics of the pumping units. The fact that the main weight and the auxiliary weights have the same weight and have the same center of gravity results in a universal, simple counterbalance relationship that can be applied throughout a very wide operational range to ensure the correct amount of weight and the correct amount of weight orientation along the crank arm for each oil well loading profile.

Figure 8:
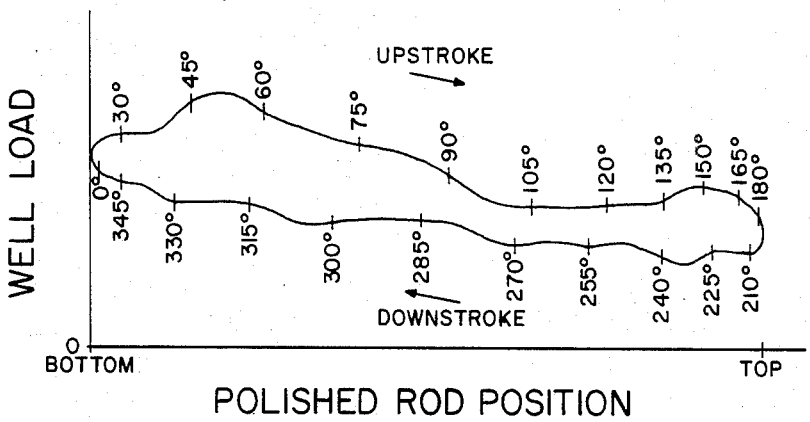
FIG. 8 is a typical well load profile versus crank arm angle curve for an oil well.
Figure 4:
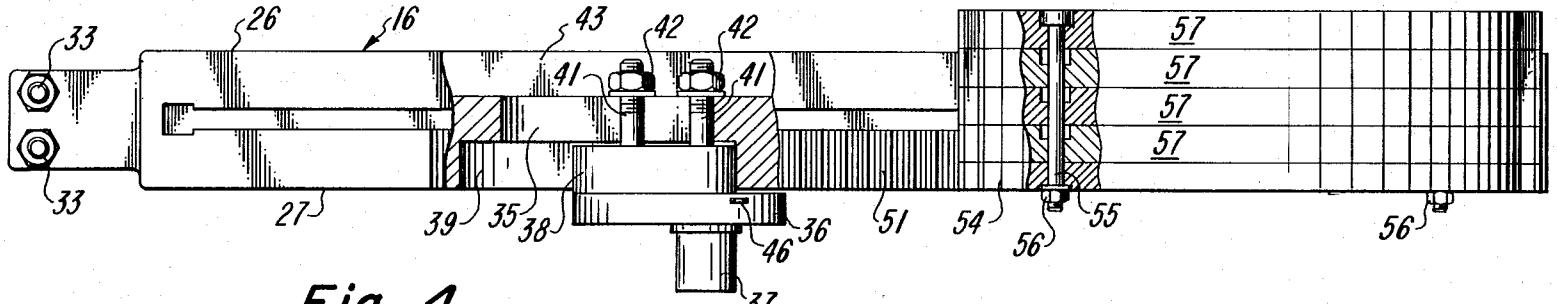
FIG. 4 is an enlarged top plan view of the crank arm and counterweight assembly shown in FIG. 3 with portions broken away to show interior parts.
Figure 3:
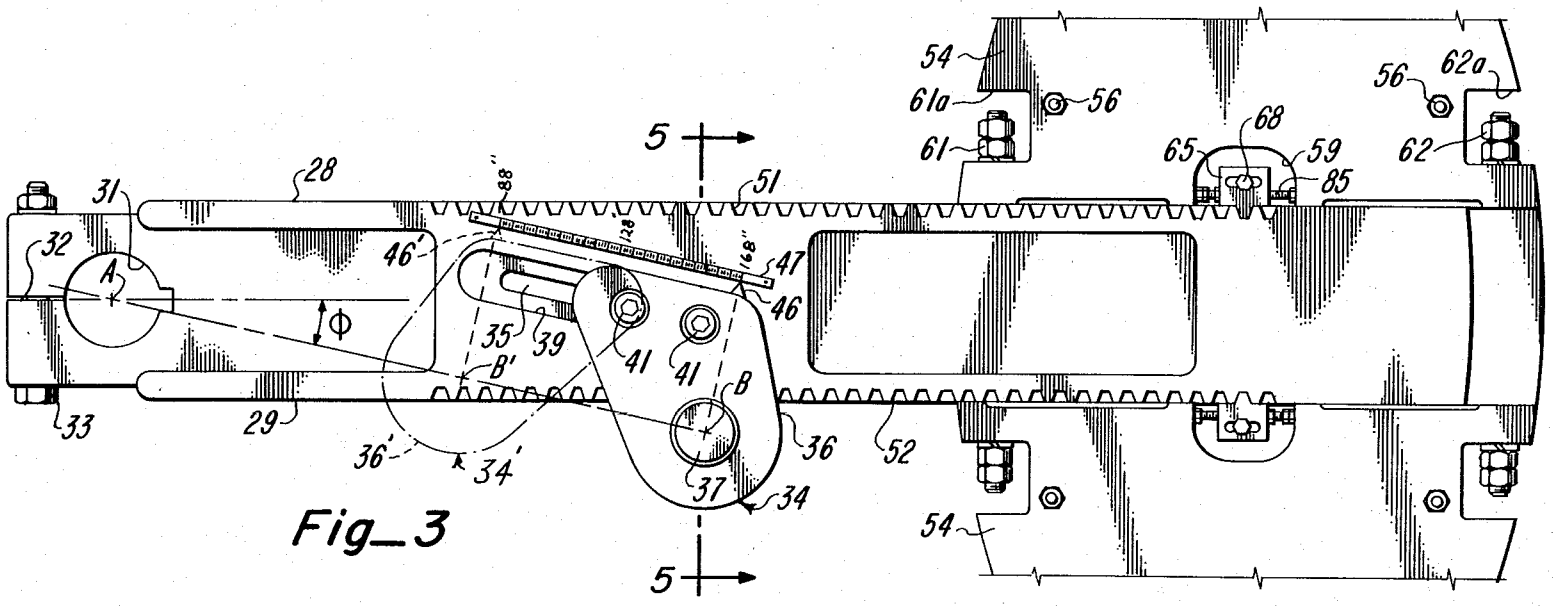
FIG. 3 is an enlarged side elevational view of a portion of the crank arm and counterweight assembly shown in FIG. 1.
Figure 5:
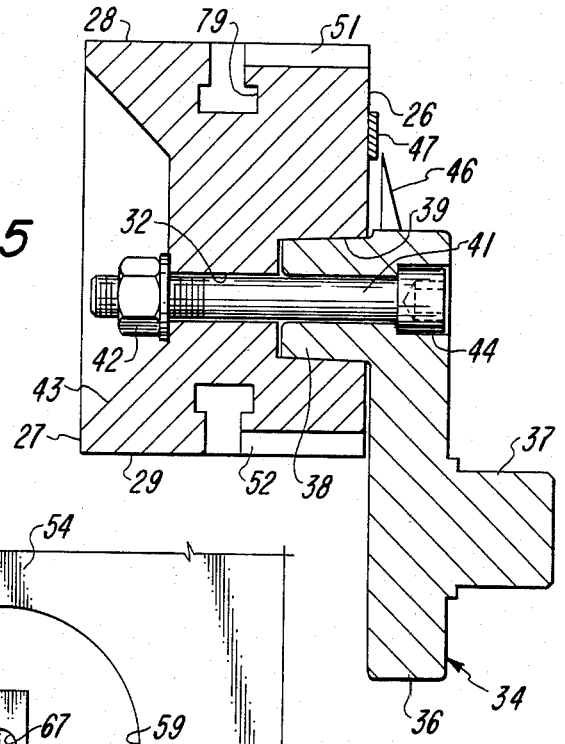
FIG. 5 is a sectional view taken along lines 5—5 of FIG. 3.
Figure 6:
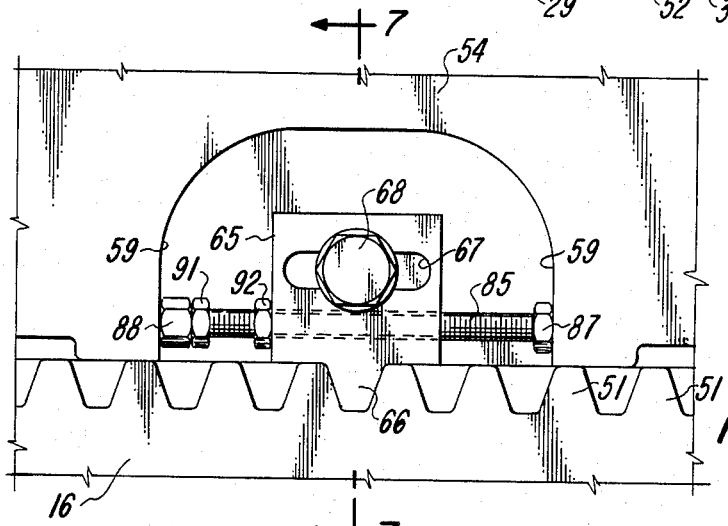
FIG. 6 is an enlarged side elevational view showing the floating lock for fastening the counterweights to the crank arm.
Figure 7:
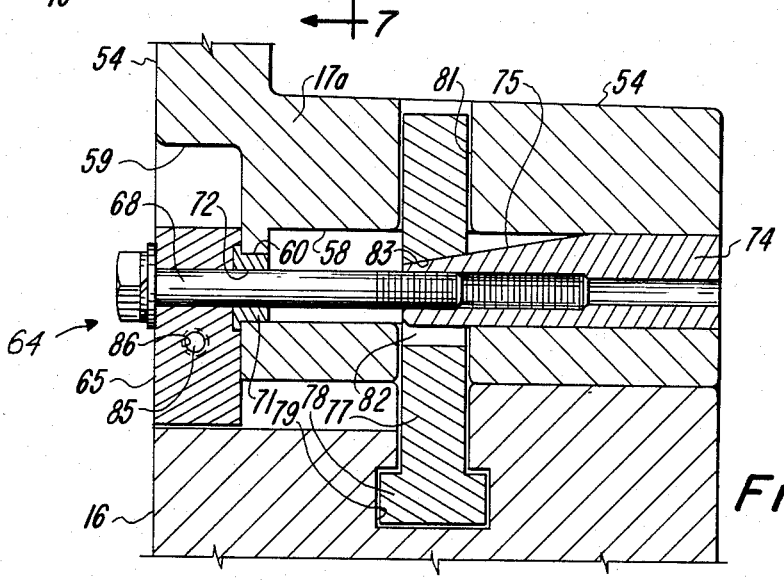
FIG. 7 is a sectional view taken along lines 7—7 of FIG. 6.

Referring now to FIG. 8, a typical oil well load profile is shown. This curve shows that the highest well load usually occurs in the first quarter cycle of the crank arm (upstroke) between 45° and 60° and the lowest well load usually occurs in the third quarter cycle of the crank arm (downstroke) between 225° and 240°. Zero degrees is defined as the 12 o-clock position of the crank arm and the crank angle increases clockwise.

As related to the oil well pumping unit shown, these instantaneous well loads are reflected through the linkage as instantaneous well load torques at the output shafts 14 of the gear reducer. These well torques are counterbalanced by the counterweight, so there are two net torque peaks of equal value. The net torque, then, is the difference between the well load torque and the counterweight torque. One net torque peak occurs in the first quarter cycle, being the difference between the high well torque and the counterweight torque, and the other peak being the difference between the gravity counterbalance torque and the low well torque characteristic of the third quarter cycle of the crank arm.

In the first quarter cycle the prime mover adds to the counterweight torque to overcome the high well torque and in the third quarter cycle the prime mover lifts the counterweight and overcomes the low well torque. The linkage of the present invention seeks to minimize the first quarter well torque and amplify the third quarter cycle well torque so as to minimize the two net torque peaks.

Figure 9:
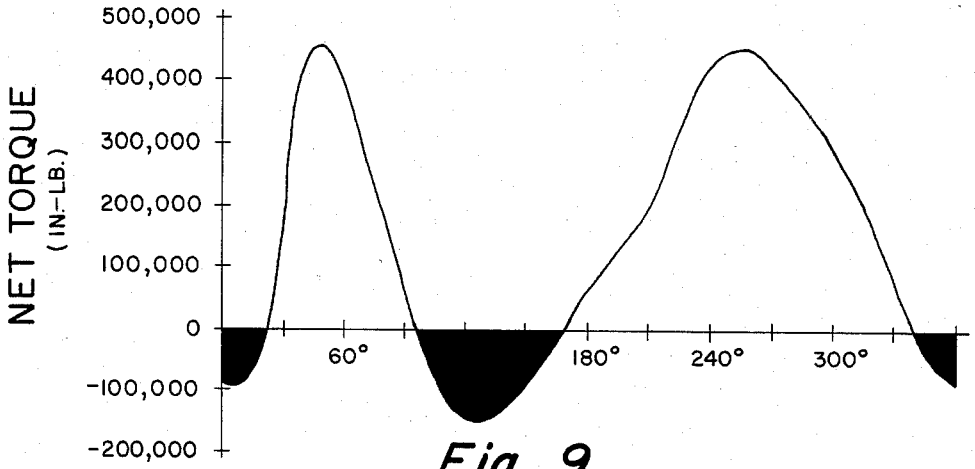
FIG. 9 is a typical net torque curve for a conventional oil well pumping unit.

A conventional oil well unit, which has the crankshaft axis directly below the equalizer pivot, a low front to rear walking beam ratio, and no angular shift between crank arm wrist pin angle and crank arm center line, has a net torque curve similar to that shown in FIG. 9. In FIGS. 9–12 the curves have net torque along the Y-axis and the angular position of the crank arm wrist pin angle plotted along the X-axis. The curve in FIG. 9 shows that the apparatus has a high rod acceleration (lower fatigue life) with a peak torque of about 456,000 inch pounds. This curve shows a peak torque requirement that is approximately 40% higher than that of the present invention and further shows gear reducer load reversals between about 0° and 25° and between 100° and 160°, which are indicated as black areas on the curve.

A gear load reversal occurs when the difference between well load torque and counterweight gravity torque becomes negative. This occurs when the gravity torque is greater than the well load torque at the gear reducer output shaft and has the same effect on an engine as when a vehicle is coasting downhill.

A load reversal may be further defined as a rapid change of the net load torque from counterclockwise to clockwise or vice versa. Net load torque is an arithmetic change between instantaneous well load torque and instantaneous counterweight torque, which can occur at various crank angle positions. A load reversal results in the rapid transfer of contact load from one side of the gear teeth to the opposite side of the gear teeth with associated impact loading and with associated speedup or slowdown of the prime mover rotational speed without changing prime mover rotational direction.

Load reversals, of necessity, come in multiples of two per revolution and, depending upon the magnitude and speed of the reversal, can cause pitting of the gear teeth, compression to tension or vice versa, bending stress reversals at the gear tooth root (fatigue), torsional and bending stress reversals on the shafts (fatigue), and shock loading throughout the structure and bearings.

Figure 10:
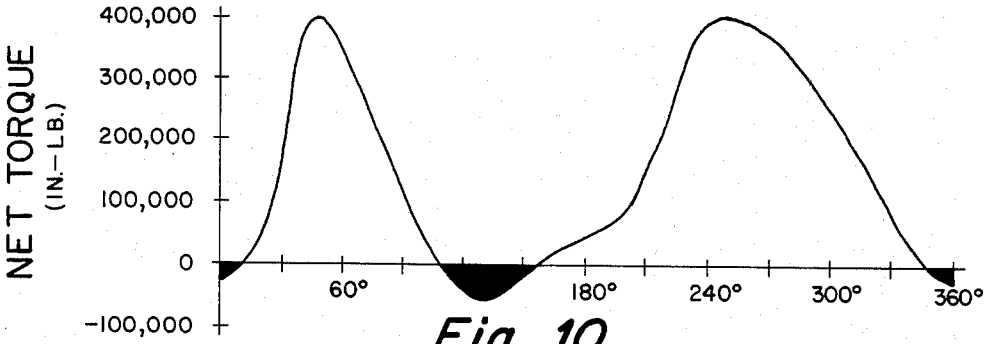
FIG. 10 is a net torque curve using increased walking beam distance ratios.

Referring now to FIG. 10, this net torque curve shows that a moderate peak torque reduction and less severe gear reducer load reversals are accomplished by increasing the front to rear walking beam distance ratio of saddle pivot-polished rod distance to saddle pivot-equalizer pivot distance to at least 1.4:1. This has been found to lower the total forward to rear angular swing of the pitman rods, slightly lower the first quarter cycle torque factor, and slightly increase the third quarter cycle torque factor.

Figure 11:
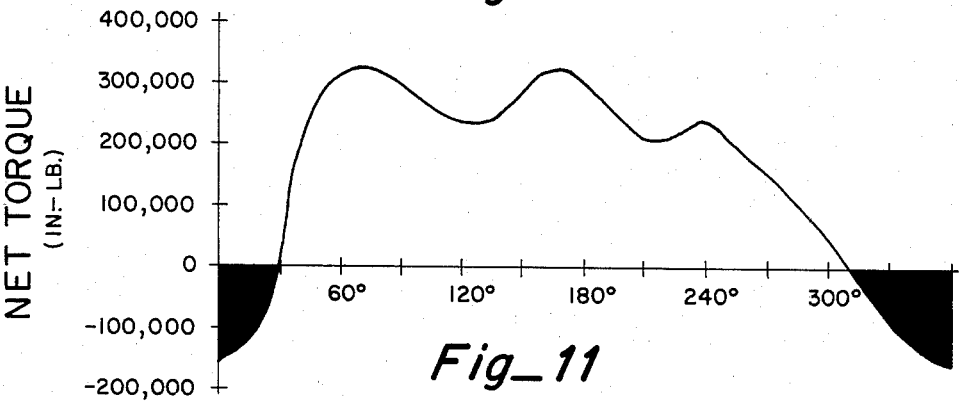
FIG. 11 is a net torque curve using increased walking beam distance ratios and substantial rearward positioning of the gear reducer.

Referring now to FIG. 11, the combination of the feature illustrated in FIG. 10 and the positioning of the gear reducer substantially to the rear of the equalizer pivot shows a substantial peak torque reduction and elimination of the middle torque reversal. Improved results are found with a rearward movement in the amount of at least 15% of the saddle pivot-equalizer pivot distance and defines what is meant by a positioning of the crank axis substantially to the rear of the equalizer pivot.

This rearward movement of the gear reducer greatly reduces the first quarter cycle torque factor and greatly increases the third quarter torque factor. In accomplishing this the middle load reversal is eliminated at the expense of a deepening initial load reversal. The rearward movement of the reducer directly increases the upstroke portion of the cycle to 193° and decreases the downstroke portion of the cycle to 167° for any given average stroke rate, and this decreases the average upstroke velocity compared to the conventional unit shown in FIG. 9. This results in a lower peak polished rod load since the instantaneous upstroke well load is velocity dependent.

In decreasing the peak well load, the resulting net torque curve is shown to be smoothed out and becomes more of a parallelogram, as is desired. This further results in lower sucker rod stress and fewer sucker rod fatigue failures.

Figure 12:
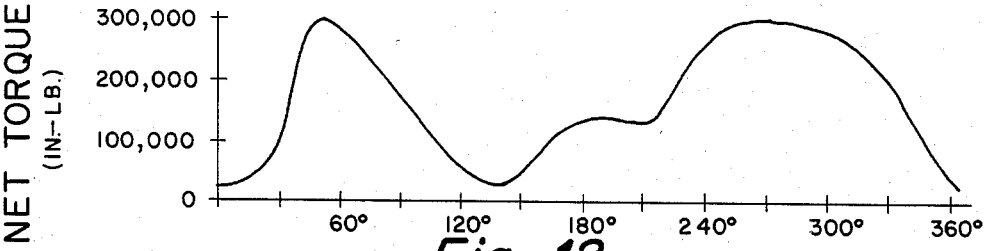
FIG. 12 is a net torque curve in an oil well pumping unit embodying all features of the present invention (distance ratios, reducer rearward, offset wrist pin line).

Referring now to FIG. 12, the combination of the features above discussed shows that the final net torque curve is accomplished by keeping the crank arm and its counterbalance weight phase shifted the selected offset angle, designated $\phi$, behind the clockwise rotating wrist pin 37. This ensures that the instantaneous difference between the well load torque and gravity torque is at no point negative. The phase shifting lowers the net torque in mid-cycle and raises the net torque in the initial phase of the cycle, as compared to FIG. 11, and thus eliminates the initial load reversal.

The net torque curve of FIG. 12 has the lowest peak torque, has no load reversals and has the gentlest loading slope at the beginning of the upstroke cycle, 0° to 50°. This is a typical net torque curve for the linkage discussed in Example 1 set forth hereinafter. Another advantage of the present invention is that the average application can be handled with one size smaller gear reducer than heretofore.

EXAMPLE 1

The optimum linkage for a peak load capacity up to 30,500 pounds and a stroke up to 100 inches is as follows:

$\phi$=15.75°
BC=124.0"
CD=88.0"
DE=129.0"
AF=125.0"
DF=122.0"
AB=29.739" for 100" stroke
AB=16.396" for 52" stroke This linkage handles all oil wells presently requiring the following eighteen API sizes: T,150

EXAMPLE 2

The optimum linkage for a peak load capacity up to 36,500 pounds and stroke up to 168 inches is as follows:

$\phi$=12.5°
BC=157.0"
CD=106.0"
DE=183.0"
AF=142.0"
DF=158.0"
AB=42.719" for 168" stroke
AB=23.984" for 88" stroke This linkage handles all oil wells presently requiring the following seventeen API sizes:

| | |
|---|---|
| 114-133-54 | 160-173-86 |
| 114-143-64 | 228-173-74 |
| 114-173-64 | 228-200-74 |
| 114-143-74 | 228-213-86 |
| 114-119-86 | 228-246-86 |
| 160-173-64 | 228-173-100 |
| 160-143-74 | 320-213-86 |
| 160-173-74 | 320-256-100 |
| 160-200-74 | 320-305-100 |

| | |
|---|---|
| 320-305-100 | 455-305-168 |
| 320-213-120 | 640-305-120 |
| 320-256-120 | 640-256-144 |
| 320-256-144 | 640-305-144 |
| 456-256-120 | 640-365-144 |
| 456-305-120 | 640-305-168 |
| 456-365-120 | 912-305-168 |
| 456-256-144 | 912-365-168 |
| 456-305-144 | |

From the foregoing the beneficial results of the universal linkage may be summarized as providing versatility in application to oil well pumping units, fine tuning of the stroke for optimal performance, lower operating torques, lower operating expenses, elimination of gear reducer load reversals, softening of upstroke loading, a single simple counterbalancing relationship, and minimum inventory and maintenance requirements.

Although the present invention has been described with a certain degree of particularity, it is understood that the present disclosure has been made by way of example and that changes in details of structure may be made without departing from the spirit thereof.

What is claimed is:

1. In an oil well pumping apparatus, a universal linkage usable throughout a range of strokes and throughout a range of gear reducer torque ratings for a selected peak load capacity, said pumping apparatus having a walking beam pivotal up and down a saddle pivot, said beam having a horsehead at the front end and carrying a polished rod and sucker rods via a bridle for extending from the horsehead into the oil well to drive a downhole pump, at least one crank rotatable at one end adapted to be driven by a prime mover about a fixed axis via a gear reducer subject to gear reducer load reversals during at least a portion of each stroke using a conventional linkage, said crank arm having a counterbalance weight mounted thereon opposite said axis of rotation, and a pitman rod pivotally connected at one end to a rear end portion of said walking beam at an equalizer pivot and to the crank arm at its opposite end, said universal linkage being characterized by the combination of:

a walking beam distance ratio of saddle pivot-polished rod distance to saddle pivot-equalizer pivot distance of at least 1.4:1 and a positioning of said crank arm axis to the rear of said equalizer pivot by an amount at least equal to 15% of the saddle pivot-equalizer pivot distance; and offset coupling means for connecting said pitman rod to said crank arm at a selected point for a selected stroke along a crank arm wrist pin angle line offset at an angle of between 5° and 20° to the center line of said crank arm, said offset coupling means including an inclined slot in an intermediate portion of said crank arm, said slot being inclined at an angle of between about 5° and 20° to the longitudinal center line of the crank arm, and a wrist pin assembly pivotally connected to the pitman rod and slidably mounted in said slot and lockable at any point along said slot, so that said counterweight trails said crank arm by said angle upon the rotation of said crank arm, in conjunction with counterbalancing provided by a selected torque arm distance and a selected amount of counterbalance weight on said crank arm for a given oil well loading profile, said selected point being variable to any setting of a continuous range of settings along said crank arm wrist pin angle line to change the stroke, whereby to reduce the peak torque requirements, eliminate gear reducer load reversals, and lower sucker rod stress during the operation of the pumping unit.

2. In apparatus as set forth in claim 1 wherein said wrist pin assembly includes:

a support plate having a wrist pin that projects out from an outer face adjacent one end and a tapered projection section that extends out from an inner side face adjacent the other end, said tapered projecting section being slidable in a tapered channel in said crank arm extending along said slot, said tapered projection being tapered along opposite sides to converge in a direction away from said inner face, said channel being tapered along opposite sides and complementary in shape to the taper of said projection.

3. In apparatus as set forth in claim 2 including fastening means extending through said support plate, tapered projecting section, and said slot to guide said wrist pin assembly for sliding movement in said slot and to lock said wrist pin assembly to said crank arm.

4. In apparatus as set forth in claim 1 including a pointer carried by said wrist pin assembly and a scale with stroke distance indicia carried by said crank arm to indicate a plurality of stroke settings on said scale.

5. In apparatus as set forth in claim 1, further characterized by being usable throughout a range of strokes of about 88 inches to 168 inches and a range of gear reducer torque ratings of about 320,000 inch pounds to 912,000 inch pounds for a peak load capacity up to 36,500 pounds, said walking beam ratio being about 183:106, and a positioning of the crank axis rearwardly of said equalizer pivot about 36 inches with said crank arm wrist pin angle being about 12.5°.

6. In apparatus as set forth in claim 1, further characterized by being usable throughout a range of strokes of about 52 inches to 100 inches and a range of gear reducer torque ratings of about 114,000 inch pounds to 320,000 inch pounds for a selected peak load capacity up to 30,500 pounds, said walking beam ratio being about 129:88, and a positioning of said crank axis rearwardly of said equalizer pivot about 37 inches with said crank arm wrist pin angle being about 15.75°.

7. In apparatus as set forth in claim 1 wherein said counterbalancing is provided by a universal counterbalancing assembly which includes a series of upper rack teeth formed in and extending along an upper face of said crank arm, a series of lower rack teeth formed in and extending along a lower face of said crank arm, an upper main weight member slidable along said upper rack teeth and lockable to said crank arm, and a lower main weight member slidable along said lower rack teeth and lockable to said crank arm.

8. In apparatus as set forth in claim 7 including a plurality of auxiliary weight members stacked side by side one on another on one side face of said main weight member and removably fastened thereto, said auxiliary weight members having the same center of gravity with respect to said first axis as said main weight member.

9. In apparatus as set forth in claim 8 wherein the weight of each auxiliary member is the same and the same as the main weight member.

10. In an oil well pumping apparatus, a universal linkage usable throughout a range of strokes and throughout a range of gear reducer torque ratings for a selected peak load capacity, said pumping apparatus having a walking beam pivotal up and down about a saddle pivot, said beam having a horsehead at the front end and carrying a polished rod and sucker rods via a bridle for extending from the horsehead into the oil well to drive a downhole pump, at least one crank rotatable at one end adapted to be driven by a prime mover about a fixed axis via a gear reducer subject to gear reducer load reversals during at least a portion of each stroke using a conventional linkage, said crank arm having a counterbalance weight mounted thereon opposite said axis of rotation, and a pitman rod pivotally connected at one end to a rear end portion of said walking beam at an equalizer pivot and to the crank arm at its opposite end, said universal linkage being characterized by the combination of:

a walking beam distance ratio of saddle pivot-polished rod distance to saddle pivot-equalizer pivot distance of at least 1.4:1 and a positioning of said crank arm axis substantially to the rear of said equalizer pivot; and offset coupling means for connecting said pitman rod to said crank arm at a selected point for a selected stroke along a crank arm wrist pin angle line offset at an angle of between 5° and 20° to the center line of said crank arm so that said counterweight trails said crank arm by said angle upon the rotation of said crank arm, in conjunction with counterbalancing provided by a selected torque arm distance and a selected amount of counterbalance weight on said frank arm for a given oil well loading profile, said selected point being variable to any setting of a continuous range of settings along said crank arm wrist pin angle line to change the stroke, whereby to reduce the peak torque requirements, eliminate gear reducer load reversals, and lower sucker rod stress during the operation of the pumping unit, said counterbalancing being provided by a universal counterbalancing assembly which includes a series of upper rack teeth formed in and extending along an upper face of said crank arm, a series of lower rack teeth formed in and extending along a lower face of said crank arm, an upper main weight member slidable along said upper rack teeth and lockable to said crank arm, and a lower main weight member slidable along said lower rack teeth and lockable to said crank arm; and a lock assembly mounted on each of said main weight members to further lock them to said crank arm, each said lock assembly including a lock member with a depending tooth portion that seats in a groove between two adjacent rack teeth, a locking bolt extending through said lock member into a hole in said main weight member with a tee bolt having a head slidable in a slot in the crank arm, said locking bolt threading into a tapered nut that moves against said tee bolt to draw said crank arm firmly against said main weight member.

11. In apparatus as set forth in claim 10 further including a guide member insertable into said hole to guide the locking bolt therein.

12. In apparatus as set forth in claim 10 further including a snugging bolt extending through said lock member having a head at one end and a nut at the opposite end and intermediate locking nuts to lock said locking member in an enlarged bore section of said hole in said main weight member.

13. In an oil well pumping apparatus, a universal linkage usable throughout a range of strokes and throughout a range of gear reducer torque ratings for a selected peak load capacity, said pumpig apparatus having a walking beam pivotal up and down about a saddle pivot, said beam having a horsehead at the front end and carrying a polished rod and sucker rods via a bridle for extending from the horsehead into the oil well to drive a downhole pump, at least one crank rotatable at one end adapted to be driven by a prime mover about a fixed axis via a gear reducer subject to gear reducer torque reversals during at least a portion of each stroke using a conventional linkage, said crank arm having a counterbalance weight mounted thereon opposite said axis of rotation, and a pitman rod pivotally connected at one end to a rear end portion of said walking beam at an equalizer pivot and to the crank arm at its opposite end, said universal linkage being characterized by the combination of:

a walking beam distance ratio of saddle pivot-polished rod distance to saddle pivot-equalizer pivot distance of at least 1.4:1 to reduce peak torque requirements and a positioning of said crank axis to the rear of said equalizer pivot by an amount at least equal to 15% of the saddle pivot-equalizer pivot distance to reduce peak torque requirements and reduce gear reducer load reversals; and offset coupling means for connecting said pitman rod to said crank arm at a selected point for a selected stroke along a crank arm wrist pin angle line offset at an angle of between 5° and 20° to the center line of said crank arm so that said counterweight trails said crank arm by said angle upon the rotation of said crank arm to eliminate gear reducer load reversals, in conjunction with a universal counterbalancing system providing a selected torque arm distance and a selected amount of counterbalance weight on said crank arm for a given oil well loading profile, said selected point being variable to any setting of a continuous range of settings along said crank angle line to change the stroke, whereby to reduce the peak torque requirements, eliminate gear reducer load reversals, and lower sucker rod stress during the operation of the pumping unit.

14. In oil well pumping apparatus, a universal counterbalancing assembly usable throughout a range of strokes and throughout a range of gear reducer torque ratings for a selected peak load capacity, said pumping apparatus having a walking beam pivotal up and down about a saddle pivot, said beam having a horsehead at the front end and carrying a polished rod and sucker rods via bridle for extending from the horsehead into the oil well to drive a downhole pump, at least one crank rotatable at one end adapted to be driven by a prime mover about a fixed axis via a gear reducer subject to gear reducer load reversals during at least a portion of each stroke using a conventional linkage, said crank arm having a counterbalance weight mounted thereon opposite said axis of rotation, and a pitman rod pivotally connected at one end to a rear end portion of said walking beam at an equalizer pivot and to the crank arm at its opposite end, said universal counterbalancing assembly being characterized by the combination of:

a series of upper rack teeth formed in and extending along an upper face of said crank arm, a series of lower rack teeth formed in and extending along a lower face of said crank arm, an upper main weight member slidable along said upper rack teeth using a gear wrench and lockable to said crank arm at a selected radial position, and a lower main weight member slidable along said lower rack teeth using a gear wrench and lockable to said crank arm;

a floating lock assembly mounted on each of said main weight members to further lock them to said crank arm, each said lock assembly including a lock member with a depending tooth portion that seats in a groove between two adjacent rack teeth, a locking bolt extending through said lock member into a hole in said main weight member with a tee bolt having a head slidable in a slot in the crank arm, said locking bolt threading into a tapered nut that moves against said tee bolt to draw said crank arm firmly against said main weight member;

a snugging bolt extending through said lock member having a head at one end, a nut at the opposite end, and intermediate locking nuts to lock said locking member in an enlarged bore section of said hole in said main weight member; and at least one auxiliary weight member stacked on one side face of said main weight member and removably fastened thereto, said auxiliary weight member having the same center of gravity with respect to said fixed axis as said main weight member, the weight of said auxiliary member being the same and the same as the main weight member.

15. A method of improving the performance of an oil well pumping unit throughout a range of strokes and a range of gear reducer torque ratings for a selected peak load capacity using a single linkage arrangement, said pumping apparatus having a walking beam pivotal up and down about a saddle pivot, said beam having a horsehead at the front end and carrying a polished rod and sucker rods via a bridle for extending from the horsehead into the oil well to drive a downhole pump, at least one crank rotatable at one end adapted to be driven by a prime mover about a fixed axis via a gear reducer subject to gear reducer load reversals during at least a portion of each stroke using a conventional linkage, said crank arm having a counterbalance weight mounted thereon opposite said axis of rotation, and a pitman rod pivotally connected at one end to a rear end portion of said walking beam at an equalizer pivot and to the crank arm at its opposite end, comprising the steps of:

increasing the ratio of saddle pivot-polished rod distance to saddle pivot-equalizer pivot distance to at least 1.4:1;

positioning the crank axis to the rear of said equalizer pivot by an amount at least equal to 15% of the saddle pivot-equalizer pivot distance; and connecting the lower end of the pitman rod to the crank arm at an angle of between 5° and 20° to the longitudinal center line of said crank arm by providing an inclined slot in an intermediate portion of said crank arm, said slot being inclined at an angle of between about 5° and 20° to the longitudinal center line of the crank arm, and providing a wrist pin assembly pivotally connected to the pitman rod, slidably mounted in said slot, and lockable at any point along said slot, in conjunction with a selected torque arm distance for the counterweight and a selected amount of counterbalance weight for a given oil well loading profile, whereby to reduce the peak torque requirements, eliminate gear load reversals, and lower sucker rod stress during the operation of the pumping unit.

* * * * *